US012582251B2

(12) United States Patent
Benzakarya, Sr.

(10) Patent No.: US 12,582,251 B2
(45) Date of Patent: Mar. 24, 2026

(54) COFFEE MUG HOLDER

(71) Applicant: David Sasson Benzakarya, Sr., Los Angeles, CA (US)

(72) Inventor: David Sasson Benzakarya, Sr., Los Angeles, CA (US)

( * ) Notice: Subject to any disclaimer, the term of this patent is extended or adjusted under 35 U.S.C. 154(b) by 13 days.

(21) Appl. No.: 18/126,592

(22) Filed: Mar. 27, 2023

(65) Prior Publication Data

US 2023/0346144 A1 Nov. 2, 2023

(51) Int. Cl.
*A47G 19/22* (2006.01)

(52) U.S. Cl.
CPC ..... *A47G 19/2227* (2013.01)

(58) Field of Classification Search
CPC ..... A47G 19/2227; A47G 19/2211; A47G 19/2216; A47G 19/2222; A47G 19/14; A47G 19/145; A47G 19/16; A47G 19/22; A47G 19/2205; A47G 19/2255; A45F 2200/0583; A45F 3/16; B65D 25/2808; B65D 25/282; B65D 25/2841; B65D 25/2852; B65D 25/2867; B65D 25/2888
USPC ..... 215/370, 374, 375, 377; 220/703, 756, 220/758
See application file for complete search history.

(56) References Cited

U.S. PATENT DOCUMENTS 3,378,177 A * 4/1968 Gran ..... A01J 9/00 220/759
2004/0108346 A1* 6/2004 Pablo ..... A45F 5/02 224/269
2007/0012707 A1* 1/2007 Rattay ..... B65D 25/2844 220/762
2007/0108156 A1* 5/2007 Durand ..... B65D 1/0223 215/375
2021/0249878 A1* 8/2021 Yamada ..... A24F 40/90

FOREIGN PATENT DOCUMENTS

GB 727289 A * 3/1955

* cited by examiner

*Primary Examiner* — Don M Anderson
*Assistant Examiner* — Laura E. Parker
(74) *Attorney, Agent, or Firm* — Sandy Lipkin

(57) ABSTRACT

A coffee mug with a height of 5½ inches from top to bottom not including a marble base which includes three marbles that are ½ inch in diameter and attached to the bottom of the mug in a symmetrical triangular configuration when viewed from the bottom provides a balanced look while distributing the weight of the mug equally on the marbles. The handle measures 3 inches in length and ¾ inch in width. A ceramic band wraps around the top of the mug and is ¼ inch thick and is attached to the handle up to the spout on both sides of the mug's upper portion. There is a ⅛-inch gap (space) between the ceramic band and the body of the mug. This band is for inserting holding, holding and hanging small decorations, such as artificial flowers, keys, glasses and also improves the mug's aesthetics. Opposite the handle is a small spout to guide the fresh flow liquid when pouring, which is ¼ inch in width and ¾ inch in length.

1 Claim, 4 Drawing Sheets

COFFEE MUG HOLDER

BACKGROUND OF THE INVENTION

Field of the Invention

The field of this invention relates generally to the field of coffee mugs and more specifically toward a coffee mug holder and decoration.

DESCRIPTION OF THE PRIOR ART

Liquid serving vessels, such as cups, glasses and mugs have been used for many years. Typically, they provide ease and aesthetic value while serving water and all types of beverages. While the cup and saucer set are usually utilized in serving tea or coffee, a coffee mug can also be a good substitute. Decorating mugs can be found everywhere but seldom can one be found with unique features.

It is the object of the instant invention to provide a coffee mug holder that can hold keys, glasses, artificial flowers and fresh flowers. A portion near the top is a circular ceramic band wherein a small decoration can be hanged or inserted. At the bottom is found a set of three marbles serving as a stand/base. A spout is added for ease when pouring liquids.

SUMMARY OF THE INVENTION

The basic embodiment of the present invention teaches a coffee mug, comprising: a ceramic body having a base and a sidewall extending upward from the base; a spout at a top edge of the sidewall; a handle on the sidewall opposite the spout; a set of marbles arranged on the base in a triangular configuration; and a circular ceramic band extending around an upper part of the sidewall, the band attached only to the spout and the handle, and the band defining a gap between the band and the sidewall on either side of the handle; the gap is configured to hold decorations.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
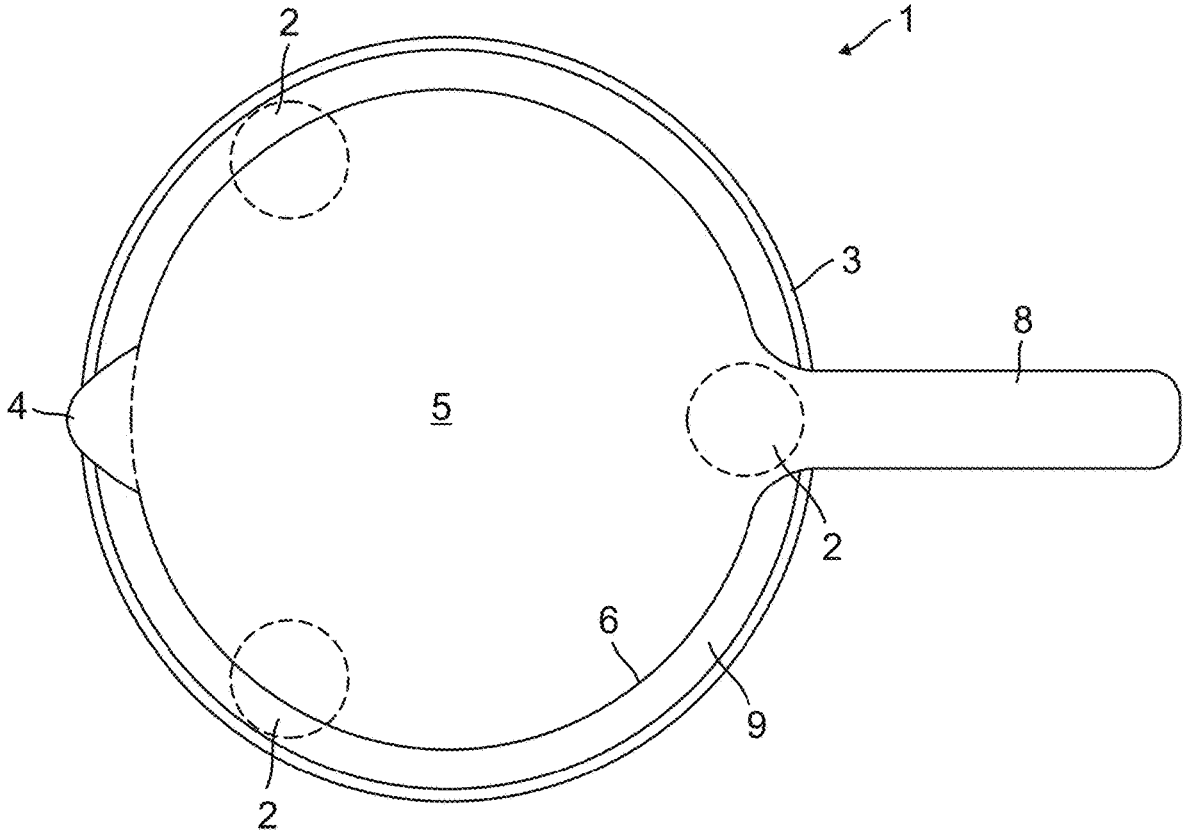
FIG. 1 is a top view of the coffee mug holder of the instant invention.
Figure 2:
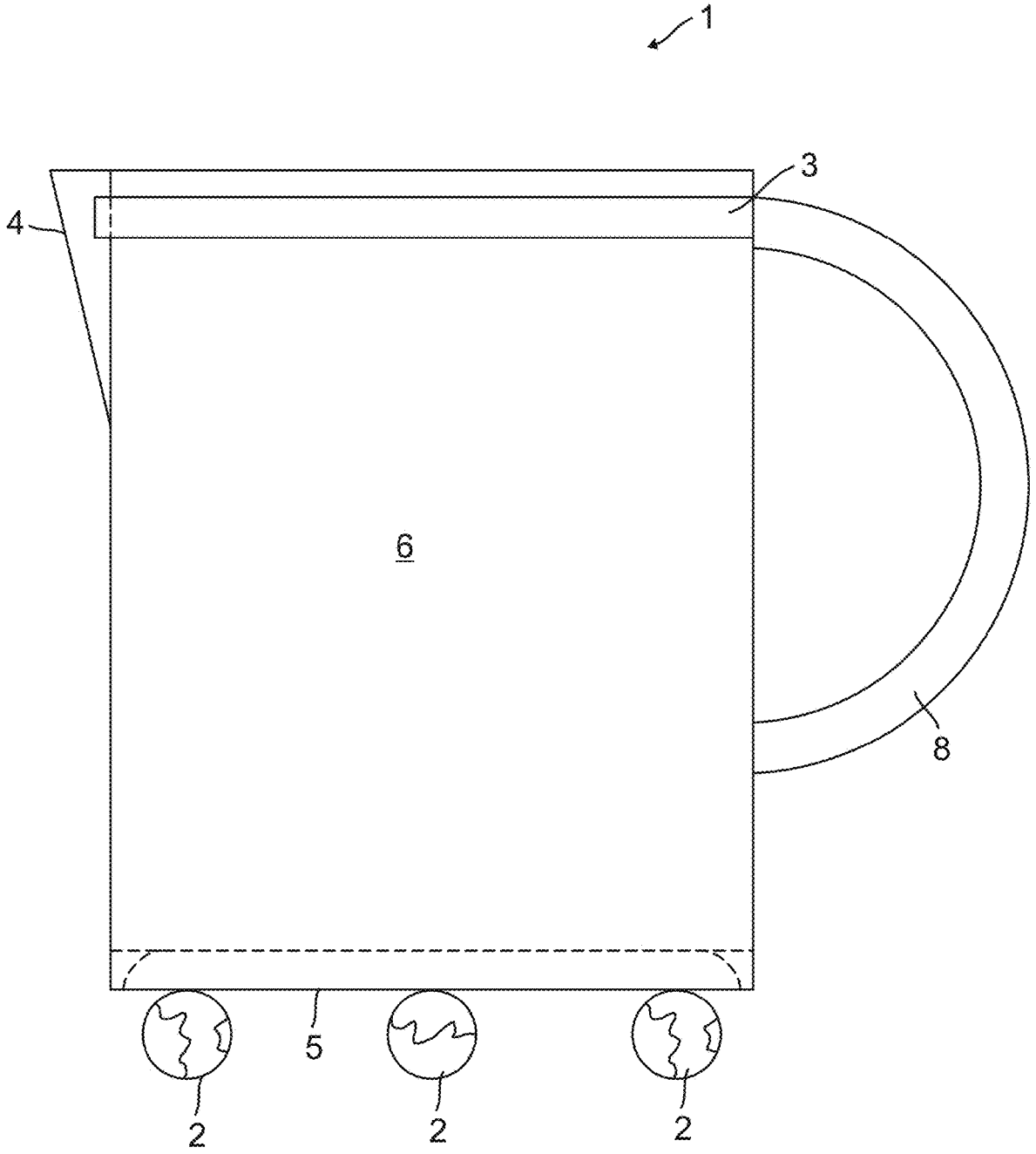
FIG. 2 is a left side view of the coffee mug holder of the instant invention.
Figure 3:
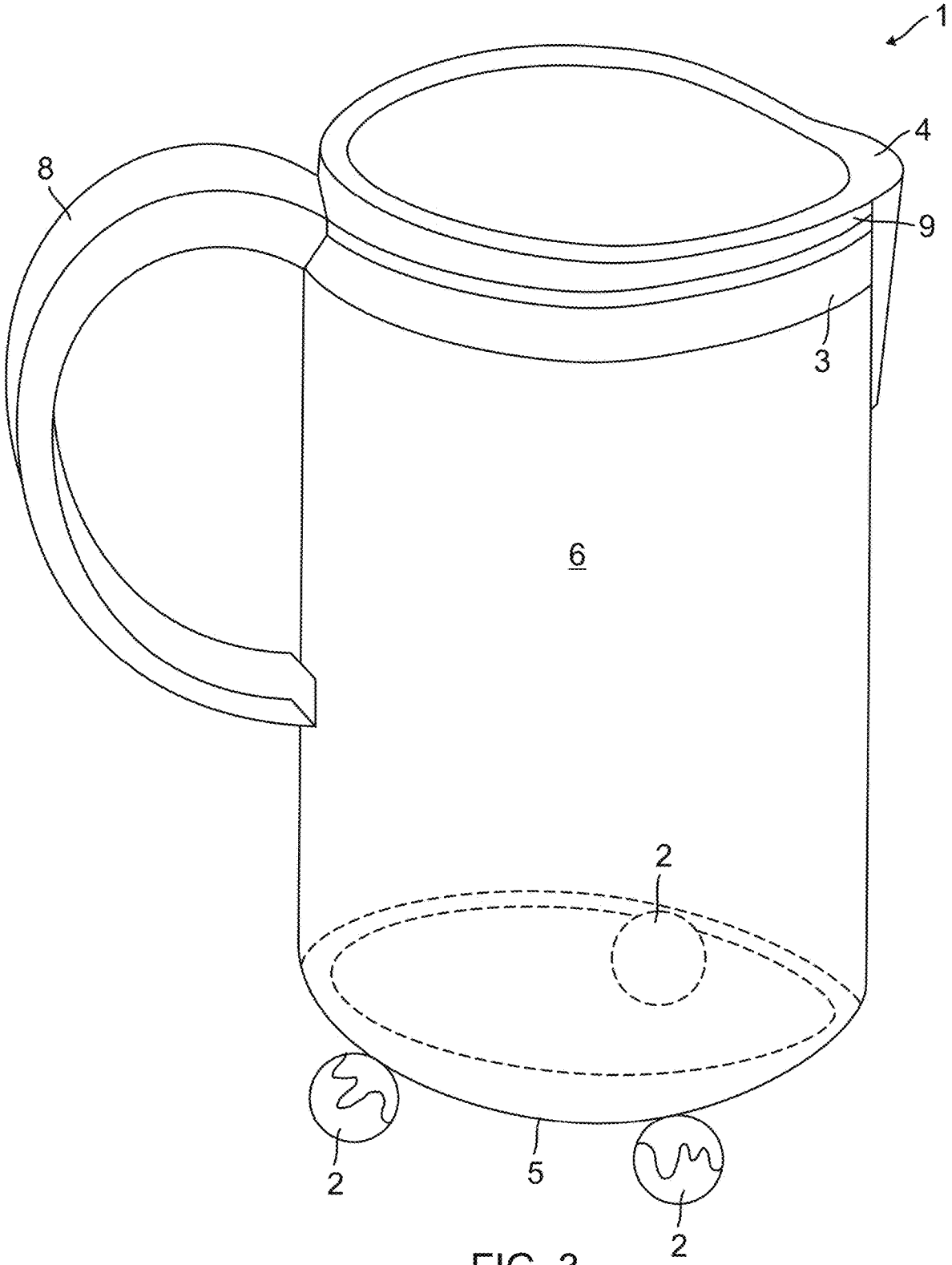
FIG. 3 is an isometric view of the coffee mug holder of the instant invention.
Figure 4:
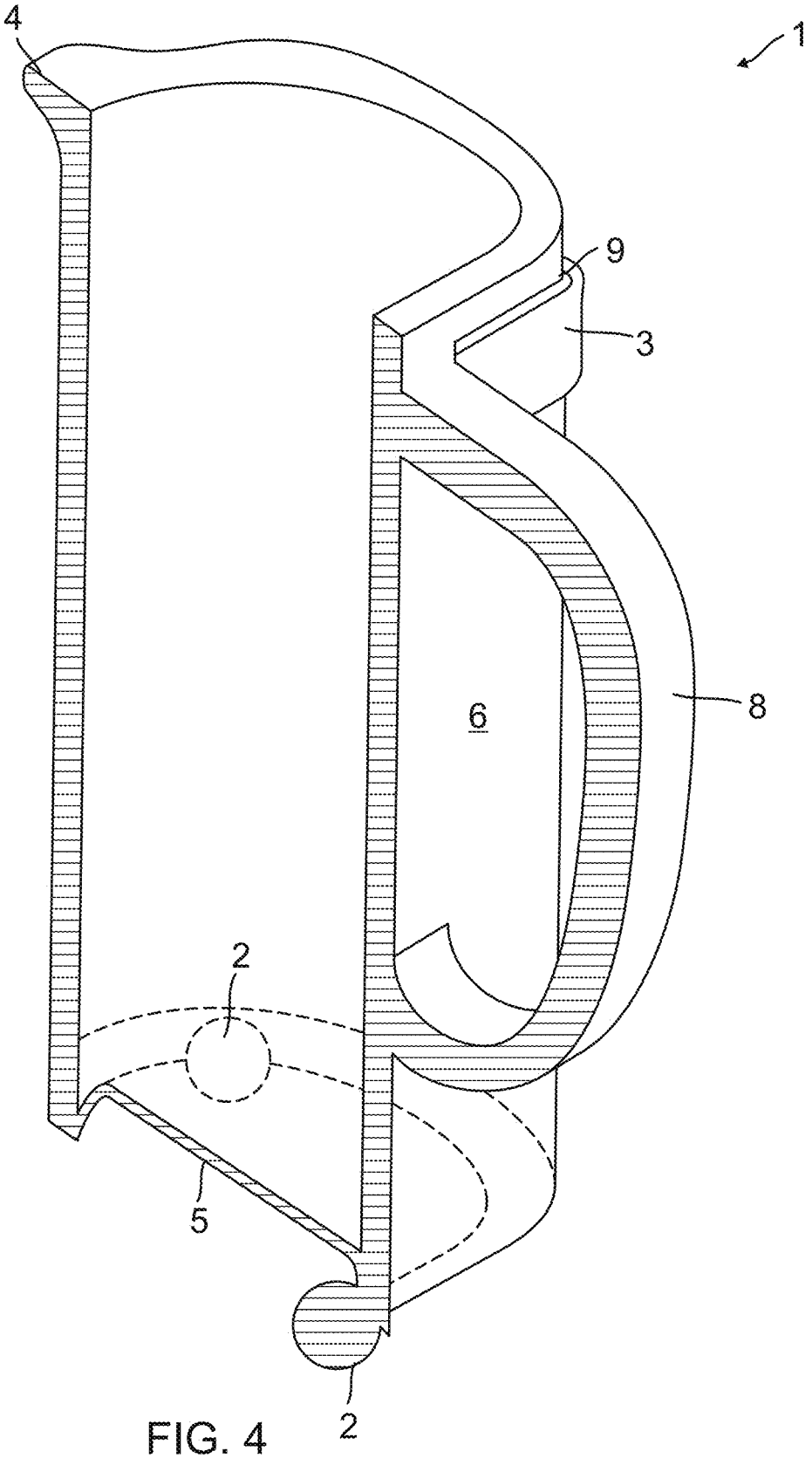
FIG. 4 is a cross sectional view of the coffee mug holder of the instant invention.

Turning to the drawings, the preferred embodiment is illustrated and described by reference characters that denote similar elements throughout the several views of the instant invention.

The preferred embodiment of the instant invention provides for a coffee mug 1 that stands on a 3-marble base 2 with a circular ceramic band 3 to hold keys, glasses and decorations. The essentials of this mug 1 are basically similar to all coffee mugs with the exception of some holdings and design concepts for both functionality and elegance. It is six inches high and four inches wide with a three-inch handle 8 and a 1½ inch spout 4. It can be a serving vessel or a coffee cup. Most coffee mugs are used for drinking coffee or other warm beverages.

On the upper part of the mug 1 is a ceramic band 3 which circles the mug 1 around its sidewall 6 from the sides of the spout 4 to the side of the handle 8. The circular band 3 "floats" around the sidewall 6 of the mug 1 and is only physically attached to the inside of the handle 8 on one and to the spout 4 on the other end. The band 3 is located near the top portion of the mug 1. If viewed from the top one can see that there is a small gap 9 or space between the band 3 and the sidewall 6 of the mug 1. This special feature serves as a holder for small decorations, such as artificial flowers, keys and glasses.

The coffee mug 1 stands on a 3-marble base 2 arranged and balanced triangularly on the bottom 5 of the mug 1. These marbles 3 serve as a unique charming base for the mug 1.

The invention claimed is:

1. A coffee mug, comprising:

a ceramic body having a base and a sidewall extending upward from the base;

a spout at a top edge of the sidewall;

a handle on the sidewall opposite the spout;

a set of marbles arranged on the base in a triangular configuration; and a circular ceramic band extending around an upper part of the sidewall, the band attached only to the spout and the handle, and the band defining a gap between the band and the sidewall on either side of the handle; the gap is configured to hold decorations.

* * * * *